US010777915B1

(12) United States Patent
Youtsey

(10) Patent No.: US 10,777,915 B1
(45) Date of Patent: Sep. 15, 2020

(54) COAXIAL CABLE CONNECTOR WITH A FRANGIBLE INNER BARREL

(71) Applicant: PCT International, Inc., Mesa, AZ (US)

(72) Inventor: Timothy L. Youtsey, Tempe, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 16/538,238

(22) Filed: Aug. 12, 2019

Related U.S. Application Data

(60) Provisional application No. 62/717,826, filed on Aug. 11, 2018.

(51) Int. Cl.
*H01R 9/05* (2006.01)
*H01R 24/40* (2011.01)
*H01R 103/00* (2006.01)

(52) U.S. Cl.
CPC ..... *H01R 9/0524* (2013.01); *H01R 24/40* (2013.01); *H01R 2103/00* (2013.01)

(58) Field of Classification Search
CPC ..... H01R 9/0524; H01R 9/05; H01R 24/38; H01R 24/40; H01R 2103/00
USPC ..... 439/578
See application file for complete search history.

(56) References Cited

U.S. PATENT DOCUMENTS 2,367,175 A 1/1945 Hahn
2,754,487 A 7/1956 Carr et al.
3,199,061 A 8/1965 Johnson et al.
4,377,320 A 3/1983 Lathrop et al.
4,629,272 A 12/1986 Mattingly et al.
4,990,104 A 2/1991 Schieferly
4,990,106 A 2/1991 Szegda
5,466,173 A 11/1995 Down
5,498,175 A 3/1996 Yeh et al.
5,501,616 A 3/1996 Holliday
5,879,191 A 3/1999 Burris
5,975,951 A * 11/1999 Burris ..... H01R 13/5202 439/322
5,993,254 A 11/1999 Pitschi et al.
5,997,350 A * 12/1999 Burris ..... H01R 9/0521 439/585
6,010,289 A 1/2000 Distasio et al.
6,042,422 A 3/2000 Youtsey
6,089,912 A 7/2000 Tallis et al.
6,153,830 A 11/2000 Montena
6,217,383 B1 4/2001 Holland et al.
6,425,782 B1 7/2002 Holland
6,648,683 B2 11/2003 Youtsey
6,712,631 B1 3/2004 Youtsey
6,729,912 B2 5/2004 DAddario
6,767,248 B1 7/2004 Hung
(Continued)

*Primary Examiner* — Peter G Leigh
(74) *Attorney, Agent, or Firm* — Thomas W. Galvani, P.C.; Thomas W. Galvani

(57) ABSTRACT

An embodiment of a coaxial cable connector includes an inner post and a coupling interface mounted on the inner post, a barrel mounted on the inner post, the barrel including a front sleeve and a rear sleeve coupled to each other at a frangible band, and a compression collar mounted over the barrel for movement between a retracted position and an advanced position. Movement of the compression collar from the retracted position to the advanced position severs the frangible band, thereby separating the front sleeve from the rear sleeve.

20 Claims, 7 Drawing Sheets

(56) References Cited

U.S. PATENT DOCUMENTS 6,848,939 B2 2/2005 Stirling
6,887,103 B2 * 5/2005 Montena ..... H01R 9/0518 439/583
7,008,263 B2 3/2006 Holland
7,018,235 B1 3/2006 Burris et al.
7,021,965 B1 4/2006 Montena et al.
7,063,565 B2 6/2006 Ward
7,125,283 B1 10/2006 Lin
7,128,603 B2 10/2006 Burris et al.
7,144,272 B1 12/2006 Burris et al.
7,182,639 B2 2/2007 Burris
7,252,546 B1 8/2007 Holland
7,288,002 B2 10/2007 Rodrigues et al.
7,300,309 B2 11/2007 Montena
7,354,307 B2 4/2008 Chee et al.
7,364,462 B2 * 4/2008 Holland ..... H01R 9/0527 439/578
7,377,809 B2 5/2008 Dyck
7,387,531 B2 6/2008 Cook
7,395,166 B2 7/2008 Plishner
7,404,373 B2 7/2008 Bailey
7,404,737 B1 7/2008 Youtsey
7,410,389 B2 8/2008 Holliday
7,458,851 B2 12/2008 Montena et al.
7,507,116 B2 * 3/2009 Laerke ..... H01R 9/0521 439/578
7,510,432 B2 3/2009 Entsfellner
7,527,524 B1 5/2009 Coleman et al.
7,568,944 B1 8/2009 Linan
7,588,460 B2 9/2009 Malloy et al.
7,753,727 B1 7/2010 Islam et al.
7,845,978 B1 12/2010 Chen
7,850,487 B1 * 12/2010 Wei ..... H01R 9/0524 439/578
7,857,661 B1 12/2010 Islam
7,934,953 B1 5/2011 Solis
7,955,088 B2 6/2011 Di Stefano
7,976,339 B2 7/2011 Buck et al.
7,997,930 B2 8/2011 Ehret et al.
8,029,316 B2 10/2011 Snyder et al.
8,038,471 B2 10/2011 Malak
8,075,339 B2 12/2011 Holliday
8,096,830 B2 * 1/2012 Rodrigues ..... H01R 9/0524 439/584
8,113,879 B1 * 2/2012 Zraik ..... H01R 9/0524 439/578
8,118,612 B2 2/2012 Morikawa
8,137,132 B2 3/2012 Lu
8,167,635 B1 5/2012 Mathews
8,272,893 B2 9/2012 Burris et al.
8,287,320 B2 10/2012 Purdy et al.
8,337,229 B2 12/2012 Montena
8,342,879 B2 * 1/2013 Amidon ..... H01R 9/0518 439/320
8,348,697 B2 1/2013 Zraik
8,366,481 B2 2/2013 Ehret et al.
8,444,433 B2 5/2013 Snyder et al.
8,465,322 B2 * 6/2013 Purdy ..... H01R 9/0524 439/584
8,469,739 B2 6/2013 Rodrigues et al.
8,491,334 B2 * 7/2013 Rodrigues ..... H01R 9/0524 439/584
8,556,656 B2 10/2013 Thomas et al.
8,568,164 B2 10/2013 Ehret et al.
8,579,658 B2 11/2013 Youtsey
8,632,360 B2 * 1/2014 Tremba ..... H01R 9/0524 439/578
8,657,626 B2 2/2014 Duval et al.
8,690,603 B2 4/2014 Bence et al.
8,753,147 B2 6/2014 Montena
8,801,448 B2 8/2014 Purdy et al.
8,834,200 B2 9/2014 Shaw
8,840,429 B2 9/2014 Thomas et al.
8,888,526 B2 11/2014 Burris
8,894,440 B2 11/2014 Rodrigues et al.
8,915,751 B2 12/2014 Wood
8,944,846 B2 2/2015 Lee
9,039,446 B2 5/2015 Youtsey
9,040,822 B2 5/2015 Nieto
9,048,599 B2 6/2015 Burris
9,071,019 B2 6/2015 Burris et al.
9,083,113 B2 7/2015 Wild et al.
9,088,078 B2 7/2015 Youtsey
9,172,157 B2 10/2015 Burris
9,257,780 B2 2/2016 Thomas et al.
9,300,094 B2 3/2016 Youtsey
9,373,902 B2 * 6/2016 Youtsey ..... H01R 9/0524
2002/0164900 A1 11/2002 Youtsey
2004/0048514 A1 3/2004 Kodaira
2005/0148236 A1 7/2005 Montena
2007/0020973 A1 1/2007 Sattele et al.
2007/0049113 A1 3/2007 Rodrigues et al.
2009/0053928 A9 2/2009 Entsfellner
2010/0261380 A1 10/2010 Skeels et al.
2010/0297875 A1 11/2010 Purdy et al.
2011/0143586 A1 6/2011 Ehret et al.
2012/0021642 A1 1/2012 Zraik
2012/0270439 A1 10/2012 Tremba et al.
2012/0329311 A1 12/2012 Duval et al.
2013/0072059 A1 3/2013 Purdy et al.
2013/0330967 A1 12/2013 Youtsey
2013/0337683 A1 12/2013 Chastain et al.
2014/0248798 A1 9/2014 Youtsey
2014/0342594 A1 11/2014 Montena
2015/0050825 A1 2/2015 Krenceski et al.
2015/0118901 A1 4/2015 Burris
2015/0162675 A1 6/2015 Davidson, Jr. et al.
2015/0180141 A1 6/2015 Wei

* cited by examiner

COAXIAL CABLE CONNECTOR WITH A FRANGIBLE INNER BARREL

CROSS-REFERENCE TO RELATED APPLICATIONS

This application claims the benefit of U.S. Provisional Application No. 62/717,826, filed Aug. 11, 2018, which is hereby incorporated by reference.

FIELD OF THE INVENTION

The present invention relates generally to electrical apparatus, and more particularly to coaxial cable connectors.

BACKGROUND OF THE INVENTION

Coaxial cables transmit radio frequency ("RF") signals between transmitters and receivers and are used to interconnect televisions, cable boxes, DVD players, satellite receivers, modems, and other electrical devices and electronic components. Typical coaxial cables include an inner conductor surrounded by a flexible dielectric insulator, a foil layer, a conductive metallic tubular sheath or shield, and a polyvinyl chloride jacket. The RF signal is transmitted through the inner conductor. The conductive tubular shield provides a ground and inhibits electrical and magnetic interference with the RF signal in the inner conductor.

Coaxial cables must be terminated with cable connectors to be coupled to mating posts of electrical devices. Connectors typically have a connector body or barrel, a threaded fitting mounted for rotation on an end of the barrel, a bore extending into the barrel from an opposed end to receive the coaxial cable, and an inner post within the bore coupled in electrical communication with the fitting. Generally, connectors are crimped onto a prepared end of a coaxial cable to secure the connector to the coaxial cable. Crimping usually requires a special tool.

When some connectors are crimped, whether by design flaw or installation flaw, gaps, holes, or pinch or pressure points can be created between the crimped or compressed connector barrel and the cable within. This can lead to RF performance issues caused by RF egress, RF ingress, and potentially unreliable grounding. It can also make the connector vulnerable to moisture intrusion, which leads to corrosion, signal degradation, and other issues. An improved connector is needed.

SUMMARY OF THE INVENTION

An embodiment of a coaxial cable connector includes an inner post and a coupling interface mounted on the inner post, a barrel mounted on the inner post, the barrel including a front sleeve and a rear sleeve coupled to each other at a frangible band, and a compression collar mounted over the barrel for movement between a retracted position and an advanced position. Movement of the compression collar from the retracted position to the advanced position severs the frangible band, thereby separating the front sleeve from the rear sleeve.

Another embodiment of a coaxial cable connector includes an inner post, a barrel mounted on the inner post, the barrel including front sleeve, a middle sleeve, and a rear sleeve, each formed integrally as part of the barrel, and a compression collar mounted over the barrel for movement between a retracted position and an advanced position. The middle sleeve separates from each of the front and rear sleeves when the compression collar moves from the retracted position to the advanced position thereof.

The above provides the reader with a very brief summary of some embodiments discussed below. Simplifications and omissions are made, and the summary is not intended to limit or define in any way the scope of the invention or key aspects thereof. Rather, this brief summary merely introduces the reader to some aspects of the invention in preparation for the detailed description that follows.

BRIEF DESCRIPTION OF THE DRAWINGS

Referring to the drawings.

DETAILED DESCRIPTION

Figure 1:
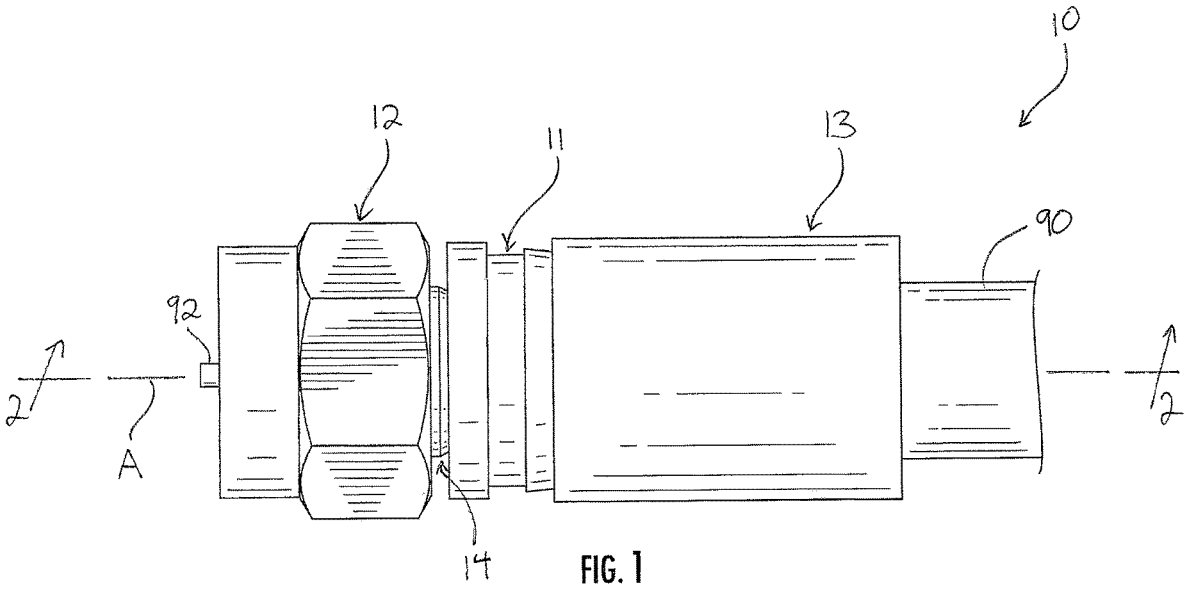
FIG. 1 is a side elevation view of a coaxial cable connector with a frangible inner barrel.
Figure 2A:
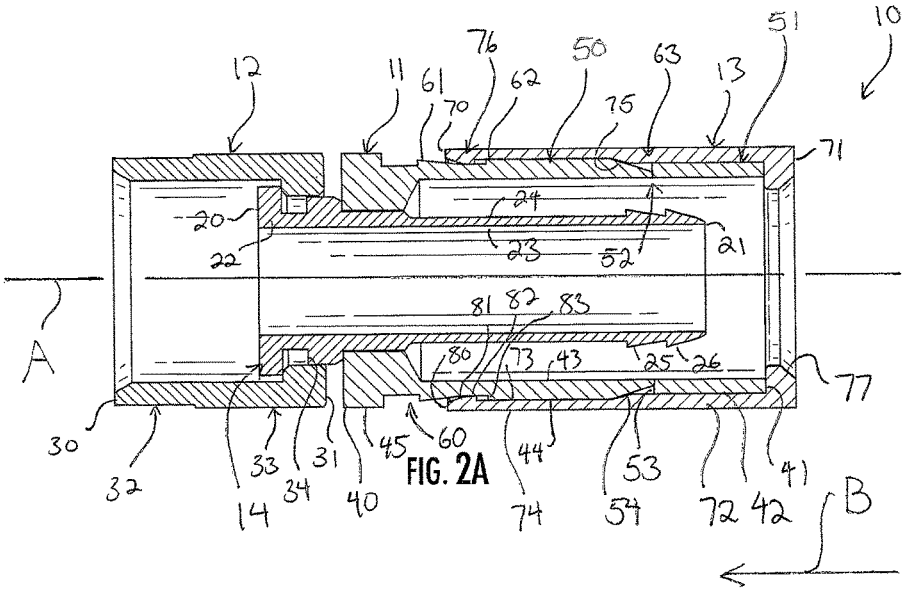
FIGS. 2A-2C are section views take along the line 2-2 in FIG. 1, showing the connector of FIG. 1 moving from an uncompressed condition to a compressed condition.

Reference now is made to the drawings, in which the same reference characters are used throughout the different figures to designate the same elements. FIG. 1 is an elevation view of a coaxial cable connector 10 with a frangible inner barrel (hereinafter, "connector 10"), and FIG. 2A is a section view bisecting the connector 10 along the line 2-2 in FIG. 1. The connector 10 includes a body or barrel 11, a coupling nut 12 mounted for rotation on the barrel 11, a compression collar 13 mounted to the barrel 11 for axial movement between retracted and advanced positions with respect to the barrel 11, and an inner post 14, on which both the barrel 11 and the coupling nut 12 are mounted. A longitudinal axis A extends through the center of the connector 10, generally defining an axis of rotational symmetry for the connector 10.

The inner post 14 is an elongate sleeve extending along the longitudinal axis A and having rotational symmetry thereabout. The inner post 14 includes opposed front and rear ends 20 and 21, a sidewall 22 extending therebetween, and opposed inner and outer surfaces 23 and 24. The outer surface 24 at the rear end 21 of the inner post 14 is formed with two annular barbs or ridges 25 and 26 projecting toward the front end 20 and radially outward from the longitudinal axis A. The ridges 25 and 26 are laterally or axially spaced apart from each other along the rear end 21 of the inner post 14. The ridges 25 and 26 provide grip on a cable applied to the connector 10 to resist withdrawal of the cable from the connector 10, and also provide an increased diameter on the inner post 14 over which the cable must be passed. In some embodiments, the inner post 14 may have other designs or structures, such as a shortened axial length.

The coupling nut 12 is mounted for rotation at the front end 20 of the inner post 14. The coupling nut 12 is a sleeve having opposed front and rear ends 30 and 31, an integrally-formed ring portion 32 proximate to the front end 30, and an integrally-formed nut portion 33 proximate to the rear end 31. The ring portion 32 has a smooth annular outer surface and an opposed inner surface which may be smooth, threaded, ribbed, or otherwise configured for engaging with a female RF mating post of an electronic component. The nut portion 33 of the coupling nut 12 has a hexagonal outer surface to receive the jaws of a tool. The coupling nut 12 is constructed of a material or combination of materials having strong, hard, rigid, durable, and high electrically-conductive material characteristics, such as metal. A gasket 34 disposed between the inner post 14 and the coupling nut 12 is constructed of a deformable yet resilient material, such as rubber, which prevents the intrusion of moisture into the connector 10, and maintains a snug fit between the coupling nut 12 and the inner post 14. In this way, a permanent, low-friction connection is established that allows the coupling nut 12 to rotate freely upon the inner post 14 about the axis A while still maintaining the coupling nut 12 and the inner post 14 in permanent electrical communication. In some embodiments, the gasket 34 may be omitted, and so the gasket 34 is not shown in other drawings of the connector 10. Moreover, in some embodiments of the connector 10, the coupling nut 12 may have another design, such as press- or push-on design, collet design, or other design which involves different structure. As such, the coupling nut 12 can be considered a "coupling interface."

The construction, structure, and arrangement of the coupling nut 12 and the inner post 14 are not critical features of this connector 10, and are shown and described here and in the drawings to provide context for the connector 10. It is noted that any suitable coupling nut and inner post may be used in the spirit of the discussion herein. The discussion now turns to the barrel 11, the compression collar 13 mounted over the barrel 11, and how those two elements are constructed, arranged, and operated within the connector 10.

Referring primarily to FIG. 2A, the barrel 11 is an elongate, cylindrical sleeve extending along the longitudinal axis A with rotational symmetry thereabout, and is constructed of a material or combination of materials having strong, rigid, size memory, and shape-memory material characteristics, as well as a low coefficient of friction, such as plastic, metal, or the like. The barrel 11 receives and securely holds a cable introduced to the connector 10.

The barrel 11 has opposed front and rear ends 40 and 41 with a cylindrical sidewall 42 extending therebetween, which sidewall 42 has opposed inner and outer surfaces 43 and 44. The inner surface 43 defines and bounds a cable-receiving interior space shaped and sized to receive the coaxial cable, and in which the rear end 21 of the inner post 14 is disposed. An opening at the rear end 41 of the barrel 11 communicates with this cable-receiving interior space.

A front flange 45 is at the front end 40 of the barrel 11. The front flange 45 is a large, inwardly-turned annular lip which abuts and is seated on the outer surface 24 of the inner post 14 behind its front end 20. It is a constriction mount on the inner post 14; the front flange 45 is seated and secured on the outer surface 24 with a friction fit, thereby securing the barrel 11 on the inner post 14.

The sidewall 42 of the barrel 11 extends rearwardly from the front flange 45, and the front flange 45 has a smaller inner diameter than any part of the sidewall 42 behind the front flange 45. Briefly, some terms are used with respect to the embodiment of the connector 10 to refer to direction or location. "Rearwardly," "behind," and similar terms indicate that something extends, is directed, or is located proximate to or toward the rear end 41 of the barrel 11. Conversely, "forwardly," "ahead," and similar terms indicate that something extends, is directed, or is located proximate to or toward the front end 30 of the coupling nut 12.

The barrel 11 is constructed from a front sleeve 50 and a rear sleeve 51 which are integrally and monolithically formed to each other at an annular, frangible band 52. The forward and rear sleeves 50 and 51 are frangible with respect to each other; they are designed to separate from each other while still encased within the compression collar 13 to grasp and secure a cable applied to the connector 10. Explained in more detail below and only introduced here, when the compression collar 13 advances forward, the rear sleeve 51 separates from the front sleeve 50 and then slides over it, causing the front sleeve 50 to deform inwardly. The barrel 11 is constructed to cause this separation in response to axial compression of the connector 10. The front sleeve 50 then captures the applied cable.

Still referring to FIG. 2A, the rear sleeve 51 is a short, cylindrical collar or cuff. The rear sleeve 51 includes the rear end 41 and the sidewall 42 of the barrel 11. From the rear end 41, the rear sleeve 51 extends forwardly to the frangible band 52. A flat or blunt front face 53 projects radially outward from the frangible band 52. The front face 53 is roughly perpendicular to the axis A and defines the forward termination of the rear sleeve 51. The front face 53 has a height, from the frangible band 52 to the outer surface 24, which is approximately half the thickness of the sidewall 42 between the inner and outer surfaces 43 and 44 just in front of the rear face 54. The rear sleeve 51 is substantially rigid and maintains its shape and size during movement and arrangement of the connector 10. In this way, the rear sleeve 51 moves with the compression collar 13, in which it is encased, when the connector 10 is secured on the cable.

In front of the rear sleeve 51, the front sleeve 50 is a cylindrical collar or cuff, is longer than the rear sleeve 51, and includes the front end 40 of the barrel 11 and the sidewall 42 extending rearwardly therefrom to an oblique rear face 54. Indeed, the front sleeve 50 extends from the front end 40 to the frangible band 52, because the frangible band 52 is formed between the front face 53 and the rear face 54. The oblique rear face 54 is oriented radially inward and axially rearward, such that the rear face 54 presents radially outward and axially rearward. In this way, the rear face 54 is an annular ramp over which the rear sleeve 51 is driven when the connector 10 is compressed, as will be discussed. The rear face 54 of the front sleeve 50 terminates rearwardly between the two axially-spaced apart ridges 25 and 26; thus, the rear end of the front sleeve 50 is directly across from a location between the two ridges 25 and 26.

The front sleeve 50 further includes the front flange 45 and an annular channel 60, just behind the front flange 45, recessed into the sidewall 22 from the outer surface 24. Proximate to and just behind the channel 60, and cooperating with the front flange 45 to bound the channel 60 is a forward barb or ridge 61 which rises radially outward, such that when the compression collar 13 is advanced axially over it, the compression collar 13 biases the ridge 61 radially inwardly slightly. Behind the ridge 61, the outer diameter of the sidewall 22 decreases slightly until it enlarges at a shoulder 62. The shoulder 62 is a forwardly-directed annular ridge defining an enlarged outer diameter of the sidewall 22. Then, from the shoulder 62 rearward, the front sleeve 50 has a constant outer diameter until the oblique rear face 54 near its rear end. As discussed above, the rear face 54 converges or tapers radially inwardly as it extends rearwardly. The rear face 54 tapers down to the frangible band 52.

The front sleeve 50 terminates rearwardly at the rear face 54, but is joined to the rear sleeve 51 at the frangible band 52. The frangible band 52 is the union between the front sleeve 50 and the rear sleeve 51. Initially, before the connector 10 is compressed, the barrel 11 is preferably a single, integral, monolithic piece and the front sleeve 50 and the rear sleeve 51 are constituent elements of that piece. The frangible band 52 joins the front sleeve 50 to the rear sleeve 51; it is an axially-narrow, radially-thinned portion of the sidewall 42 of the barrel 11 formed between the rear face 54 of the front sleeve 50 and the front face 53 of the rear sleeve 51. The frangible band 52 is preferably a thinned portion of the sidewall 42 which is continuous and annular and formed entirely to each of the rear face 54 and the front face 53. In alternate embodiments, however, the frangible band 52 has another structure, such as a series of small, circumferentially-separated fingers of the sidewall 42 formed between the two faces 53 and 54, or some other structure.

The frangible band 52 is radially encircled by the front face 53 of the rear sleeve 51, which front face 53 projects radially outward from the frangible band 52. The frangible band 52 is radially closer to the axis A than is the front face 53. Moreover, the rear face 54 of the front sleeve 50 rises obliquely away from the frangible band 52. Thus, a V-shaped annular notch 64 is defined above—or just radially outside of—the frangible band 52, encircling the band 52. The notch 64 is bound by the frangible band 52, the rear face 54, and the compression collar 13.

With continuing reference to FIG. 2A, the compression collar 13 is mounted for reciprocal axial movement over the barrel 11. It includes opposed front and rear ends 70 and 71, an annular sidewall 72 extending between the front and rear ends 70 and 71, and opposed inner and outer surfaces 73 and 74. An interior space bound by the inner surface 73 extends into the compression collar 13 from an opening formed at the rear end of the compression collar 13. The interior space is a cylindrical bore and is sized to receive the barrel 11 with the coaxial cable carried within. The compression collar 13 is fit onto the rear end 41 of the barrel 11 so as to limit the relative radial and rotational movement of the compression collar 13 on the barrel 11 with respect to the axis A. The compression collar 13 is constructed of a material or combination of materials having strong, hard, rigid, resilient, and durable material characteristics, such as metal, plastic, or the like. The compression collar 13 does not deform in response to movement between its retracted and advanced positions, or in response to deformation, movement, or other change of the barrel 11 within.

The compression collar 13 has a constant outer diameter from the front end 70 to just in front of the rear end 71. Most of the length of the sidewall 72 has one of two inner diameters; a larger inner diameter proximate the front end 70 (and resulting in a thinner sidewall 72 there) and a smaller inner diameter proximate the rear end 71 (and resulting in a thicker sidewall 72 there). At the rear end 71, the sidewall 72 has an inwardly-directed lip 77. The lip 77 has a reduced inner diameter relative the rest of the compression collar 13, and relative the smaller inner diameter proximate the rear end 71. Indeed, the inner diameter of the lip 77 is even smaller than the inner diameter of the barrel 11 at its rear end 41, such that it hangs over the rear end 41 of the barrel 11. The lip 77 serves as a stop against the barrel 11, so that, when the compression collar 13 is moved forward, the lip 77 contacts the rear end 41 of the barrel 11 and pushes the rear end 41 forward along the axis A, thereby urging deformation of the barrel 11.

The inner diameter of the compression collar 13 is constant from the lip 77 forward, until an oblique face 75 approximately halfway along the length of the compression collar 13. The oblique face 75 extends into the sidewall 72, reducing its inner diameter. The oblique face 75 is an annular expansion of the inner surface 73 of the compression collar 13, extending radially into the sidewall 72 from the inner surface 73, and the face 75 has a larger inner diameter than the portion of the sidewall 72 behind it. The oblique face 75 is directed forward and into the connector 10, toward the axis A.

From the oblique face 75, the compression collar 12 continues to extend axially forward with a constant-diameter sidewall 72 until a ring 76 at the front end 70. The ring 76 is an annular constriction of the sidewall 72, extending radially into the interior space within the compression collar 13, and defining a constricted forward mouth of the compression collar 13. The thickness of the ring 76, between its inner and outer diameters, is approximately one-third to one-half larger than the thickness of the sidewall 72 between its inner and outer surfaces 73 and 74 behind the ring 76. The inner diameter of the ring 76 corresponds to the outer diameter of channel 60 in the front sleeve 50.

The ring 76 is a projection extending radially inward. It includes a blunt front face 80, an oblique face 81, an inner face 82, and the rear face 83. The front face 80 is normal to the axis A, and the inner face 82 is parallel to it. The oblique face 81 extends between the front and inner faces 80 and 82 at a low angle degree angle, though other angles are suitable as well. The rear face 83 of the ring 76 is normal to the axis A and is directed toward the rear end 71 of the compression collar 13.

Figure 2B:
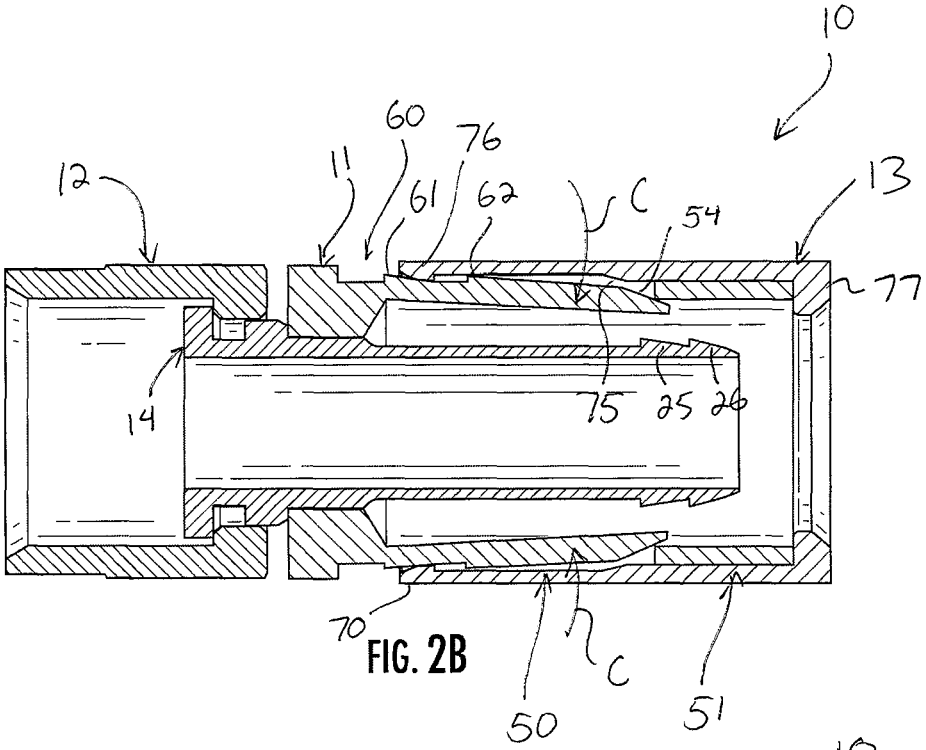
Figure 2C:
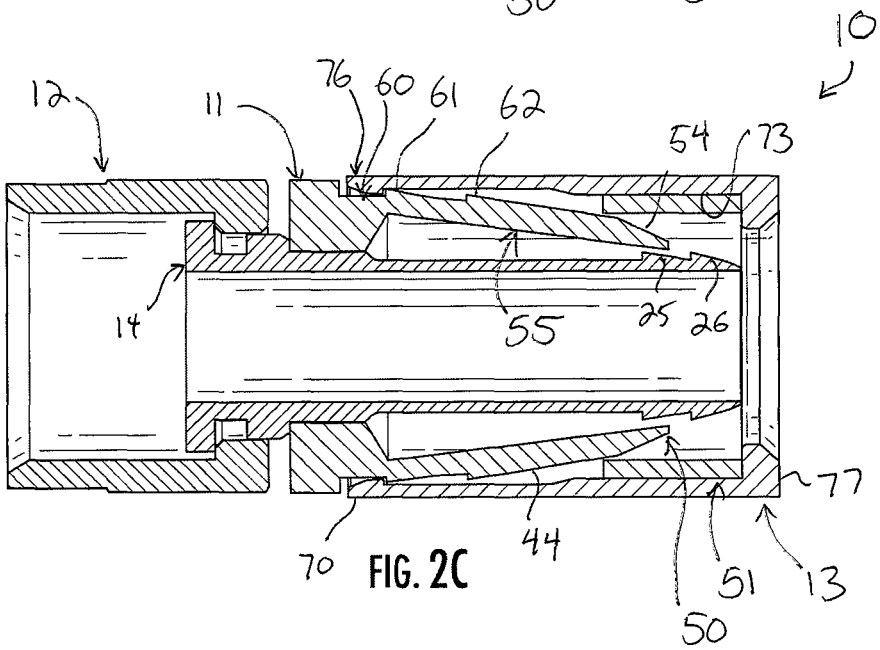
Figure 3A:
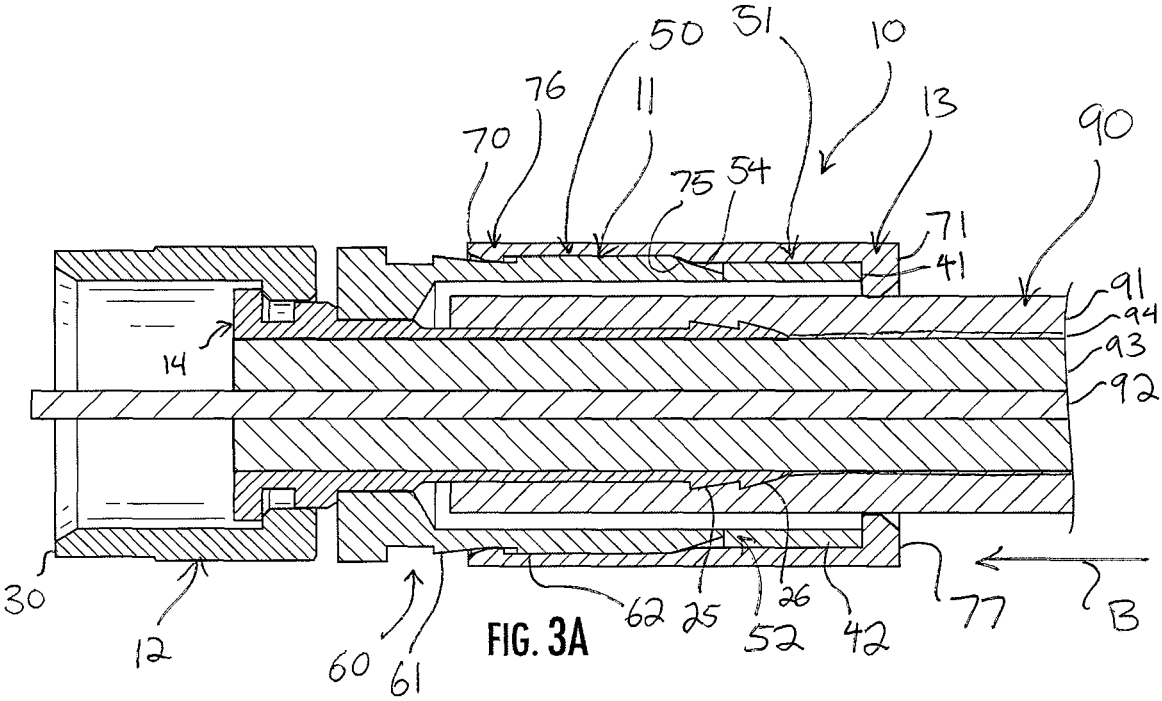
FIGS. 3A-3C are section views take along the line 2-2 in FIG. 1, showing the connector of FIG. 1, applied with a cable, moving from the uncompressed condition to the compressed condition.

In operation, the cable connector 10 is useful for securely coupling a coaxial cable to an electronic component in electrical communication. Operation of the connector 10 is shown sequentially in FIGS. 2A-2C, which does not show a cable, and in FIGS. 3A-3C, which does show a coaxial cable 90. The cable 90 must be prepared before installation. Preparation is conventional and need not be described in detail, but involves stripping back a jacket 91 to expose the center conductor 92, a dielectric insulator 93, a flexible shield 94, and sometimes a braid. The prepared end of the coaxial cable 90 is introduced to the connector 10 by registering the center conductor with the opening at the rear end 71 of the compression collar 13 and advancing the cable 90 therethrough. The connector 10 is initially in an uncompressed condition, and the compression collar 13 is in the retracted position, as shown in FIGS. 1, 2A, and 3A.

In the retracted position of the compression collar 13, the front end 70 of the compression collar 13 is behind the channel 60 and the ridge 61, such that the ring 76 is disposed between the ridge 61 and the shoulder 62. The lip 77 at the rear end 71 of the compression collar 13 is flush against the rear end 41 of the barrel 11. The compression collar 13 does not compress, deform, or bias the barrel 11 or any part of the barrel 11. Rather, the compression collar 13 is merely fit to the barrel 11.

The coaxial cable 90 is advanced into the interior space of the barrel 11 and over the inner post 14 until the dielectric insulator 93 is proximate to the front end 20 of the inner post 14, the jacket 91 (with the flexible shield 94 bent over it) is proximate to the front flange 45, and the center conductor 92 extends beyond the front end 30 of the coupling nut 12. In this arrangement, the coaxial cable is fully applied into the connector 10, but the connector 10 is not yet secured on the coaxial cable 90. This is shown in FIG. 1 and FIG. 3A.

To secure the connector 10 on the coaxial cable 90, the compression collar 13 is advanced forwardly along the direction indicated by the arrowed line B in FIG. 1B. Briefly, forward movement of the compression collar 13 is preferably accomplished by a compression tool, but in some cases may be possible manually by hand. Certain designs of connectors, especially those with specially-designed coupling nuts 12, will accommodate manual, tool-less, hand installation. Forward movement advances the compression collar 13 forwardly over the barrel 11 out of the retracted position. In the retracted position, the lip 77 is initially disposed against the rear end 41 of the barrel 11, and the ring 76 is disposed between the ridge 61 and the shoulder 62. The oblique face 75 of the compression collar 13 is disposed in contact against the oblique rear face 54 of the front sleeve 50 of the barrel 11.

Figure 3B:
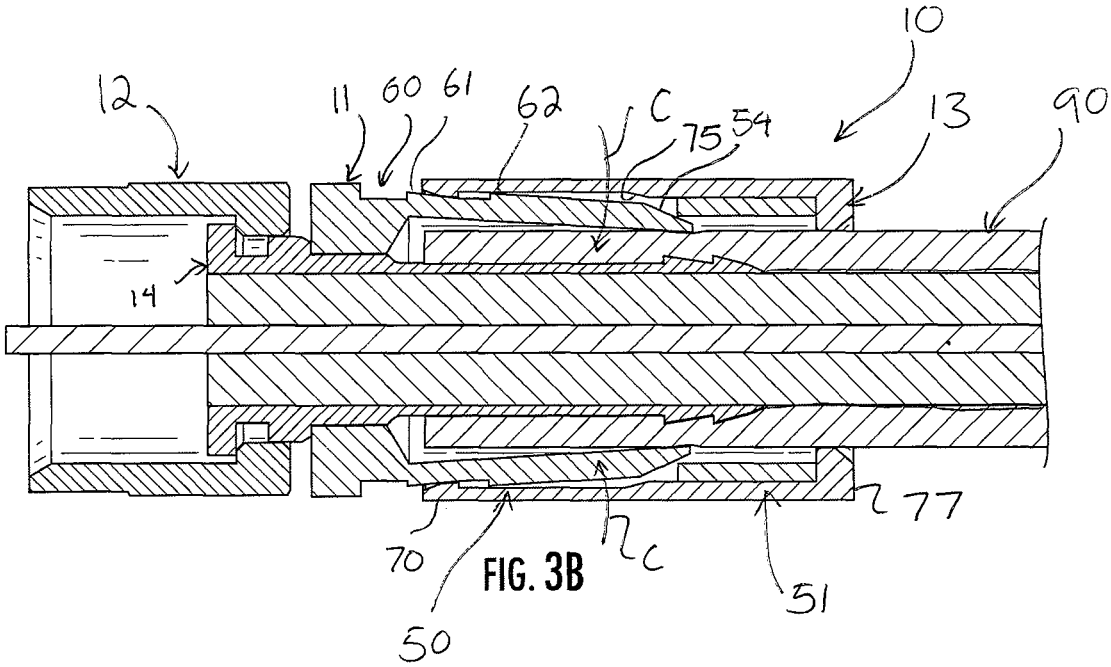

As shown in both FIGS. 2A and 3A, when the compression collar 13 is advanced forward along the arrowed line B, the oblique face 75 slides against the rear face 54 of the front sleeve 50. Because the compression collar 13 is constructed of strong, hard, rigid, resilient, and durable material characteristics, it urges the rear face 54 radially inward in deformation, as shown in FIGS. 2B and 3B by the two arcuate lines C. Moreover, the lip 77 pushes the rear sleeve 51 axially forwardly while the rear face 54 is being urged inwardly. The sidewall 42 at the frangible band 52 is thin in comparison to the rest of the barrel 11, and so the force of the deformation is concentrated here, causing the frangible band 52 to tear. With continued application of force, the frangible band 52 breaks completely, severing and separating the front sleeve 50 from the rear sleeve 51.

FIGS. 2B and 3B thus show the front sleeve 50 in a deformed condition, beginning its deformation into the connector 10 by the advancing compression collar 13 and the rear sleeve 51 it pushes axially forward. The rear end of the front sleeve 50, proximate the rear face 54, becomes increasingly deflected radially inward as the compression collar 13 advances. The rear face 54 slides under, or within, the rear sleeve 51. The front sleeve 50, behind the front flange 45, deforms to accommodate the rear face 54 beginning to slide under the rear sleeve 51. The gap or distance between the ridges 25 and 26 on the inner post 14 and the inner surface of the barrel 11 at the rear of the front sleeve 50 decreases. The rear sleeve 51 is a now free piece contained within the connector 10 by the sidewall 72 and lip 77 of the compression collar 13, and the outer surface 44 of the barrel 11 along the front sleeve 50.

Figure 3C:
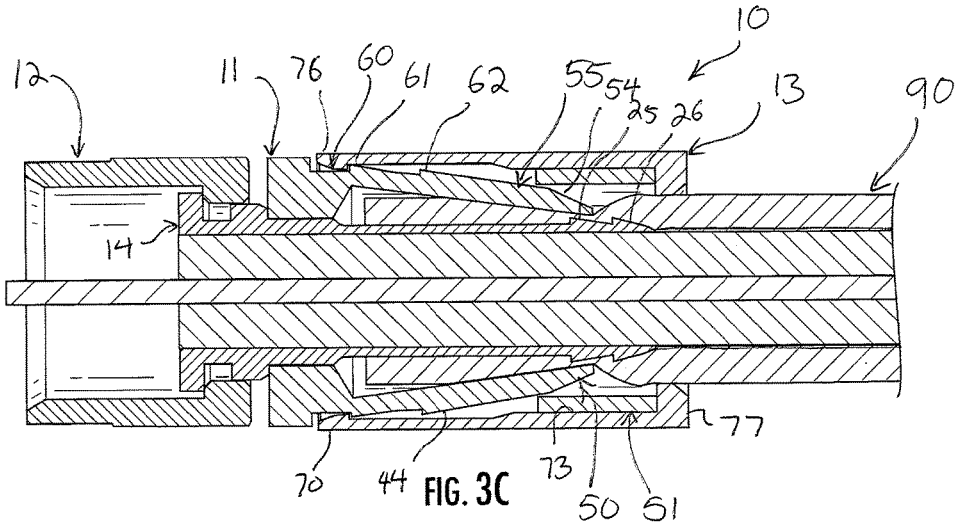

In FIGS. 2B and 3B, the ring 76 and the front end 70 of the compression collar 13 are not yet in the channel 60 of the barrel 11, and so the compression collar 13 can be further advanced along line B. Further advancement arranges the connector 10 as shown in FIGS. 2C and 3C, with the compression collar 13 in the advanced position thereof. The ring 76 moves over the ridge 61 and is snappedly received and seated into the channel 60 in front of the ridge 61. The ridge 61 is forwardly-directed and so prevents retraction of the ring 76 out of the channel 60 and thus prevents retraction of the compression collar 13 off of the barrel 11.

As shown in FIGS. 2C and 3C, the rear sleeve 51 has fully deformed the rear portion of the front sleeve 50 radially inward. This deformed portion is identified with the reference character 55, and extends form the annular channel 60 back to the rear face 54. It is annular, and is obliquely arranged from the ring 65 of the compression collar 13 to between the ridges 25 and 26 of the inner post 14. The front sleeve 50 is thus deformed from the shoulder 61 rearward. It can be seen in FIG. 3C that the deformed portion 55 of the barrel 11 has reduced the space between the barrel 11 and the inner post 14—between the inner surface of the barrel 11 and the outer surface 24 of the inner post 14. This gap is not just reduced in a single annular location, but is reduced across nearly the entire of the length of the front sleeve 50, along the deformed portion 55, from the torn frangible band 52 to the front flange 45. As such, the barrel 11 crimps the cable 90 along a considerable length of the cable 90, thereby preventing the cable 90 from getting "pinched" at a single location. This mitigates any local force concentrations on the cable 90, local and extreme deformation of the cable, and mitigates any disruption to the magnetic field created by the cable 90.

In the advanced position of the compression collar 13, the rear sleeve 51 "floats" within the interior of the connector 10 because it is free, but it is also generally prevented from axial, radial, or rotational movement by its tight fit between the inner surface 73 of the compression collar 13, the lip 77, and the outer surface 44 of the barrel 11 at the front sleeve 50. Further, the rear sleeve 51 prevents the cable 90 from being retracted; if the cable 90 is inadvertently pulled backward, it urges the deformed front sleeve 50 radially outward, in confrontation with the rear sleeve 51. The rear sleeve 51, however, is bound on all sides and cannot move. Since the rear sleeve 51 is hard, it prevents the deformed front sleeve 50 from being moved radially outward, and thereby prevents the cable 90 from being pulled out of the connector 10.

Figure 4:
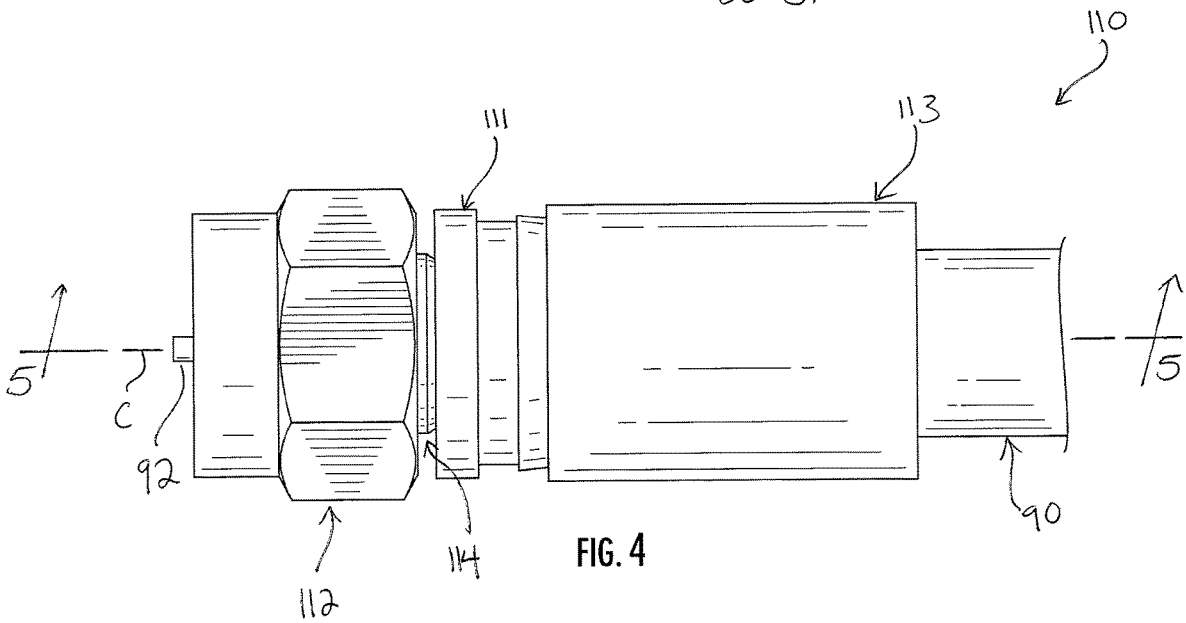
FIG. 4 is a side elevation view of a coaxial cable connector with a frangible inner barrel.

FIGS. 4-6C illustrate another coaxial cable connector with a frangible inner barrel (hereinafter, "connector 110"). FIG. 4 is an elevation view of the connector, and FIG. 5A is a section view bisecting the connector 110 along the line 5-5 in FIG. 4. The connector 110 includes a body or barrel 111, a coupling nut 112 mounted for rotation on the barrel 111, a compression collar 113 mounted to the barrel 111 for axial movement between retracted and advanced positions with respect to the barrel 111, and an inner post 114, on which both the barrel 111 and the coupling nut 112 are mounted. A longitudinal axis C extends through the center of the connector 110, generally defining an axis of rotational symmetry for the connector 110.

The inner post 114 is an elongate sleeve extending along the longitudinal axis D and having rotational symmetry thereabout. The inner post 114 includes opposed front and rear ends 120 and 121, a sidewall 122 extending therebetween, and opposed inner and outer surfaces 123 and 124. The outer surface 124 at the rear end 121 of the inner post 114 is formed with two annular barbs or ridges 125 and 126 projecting toward the front end 120 and radially outward from the longitudinal axis D. The ridges 125 and 126 are laterally or axially spaced apart from each other along the rear end 121 of the inner post 114. The ridges 125 and 126 are spaced apart from each other significantly more so than are the ridges 125 and 126 in the connector 110. The ridges 125 and 126 provide grip on a cable applied to the connector 110 to resist withdrawal of the cable from the connector 110, and also provide an increased diameter on the inner post 114 over which the cable must be passed. In some embodiments, the inner post 114 may have other designs or structures, such as a shortened axial length.

The coupling nut 112 is mounted for rotation at the front end 120 of the inner post 114. The coupling nut 112 is a sleeve having opposed front and rear ends 130 and 131, an integrally-formed ring portion 132 proximate to the front end 130, and an integrally-formed nut portion 133 proximate to the rear end 131. The ring portion 132 has a smooth annular outer surface and an opposed inner surface which may be smooth, threaded, ribbed, or otherwise configured for engaging with a female RF mating post of an electronic component. The nut portion 133 of the coupling nut 112 has a hexagonal outer surface to receive the jaws of a tool. The coupling nut 112 is constructed of a material or combination of materials having strong, hard, rigid, durable, and high electrically-conductive material characteristics, such as metal. A gasket 134 disposed between the inner post 114 and the coupling nut 112 is constructed of a deformable yet resilient material, such as rubber, which prevents the intrusion of moisture into the connector 110, and maintains a tight fit between the coupling nut 112 and the inner post 114. In this way, a permanent, low-friction connection is established that allows the coupling nut 112 to rotate freely upon the inner post 114 about the axis D while still maintaining the coupling nut 112 and the inner post 114 in permanent electrical communication. In some embodiments, the gasket 134 may be omitted, and so the gasket 134 is not shown in other drawings of the connector 110. Moreover, in some embodiments of the connector 110, the coupling nut 112 may have another design, such as press- or push-on design, collet design, or other design which involves different structure. As such, the coupling nut 112 can be considered a "coupling interface."

The construction, structure, and arrangement of the coupling nut 112 and the inner post 114 are not critical features of this inventive connector, and it is noted that any suitable coupling nut and inner post may be used in the spirit of the discussion herein. The discussion now turns to the barrel 111, the compression collar 113 mounted over the barrel, and how those two elements are constructed, arranged, and operated within the connector 110.

Figure 5A:
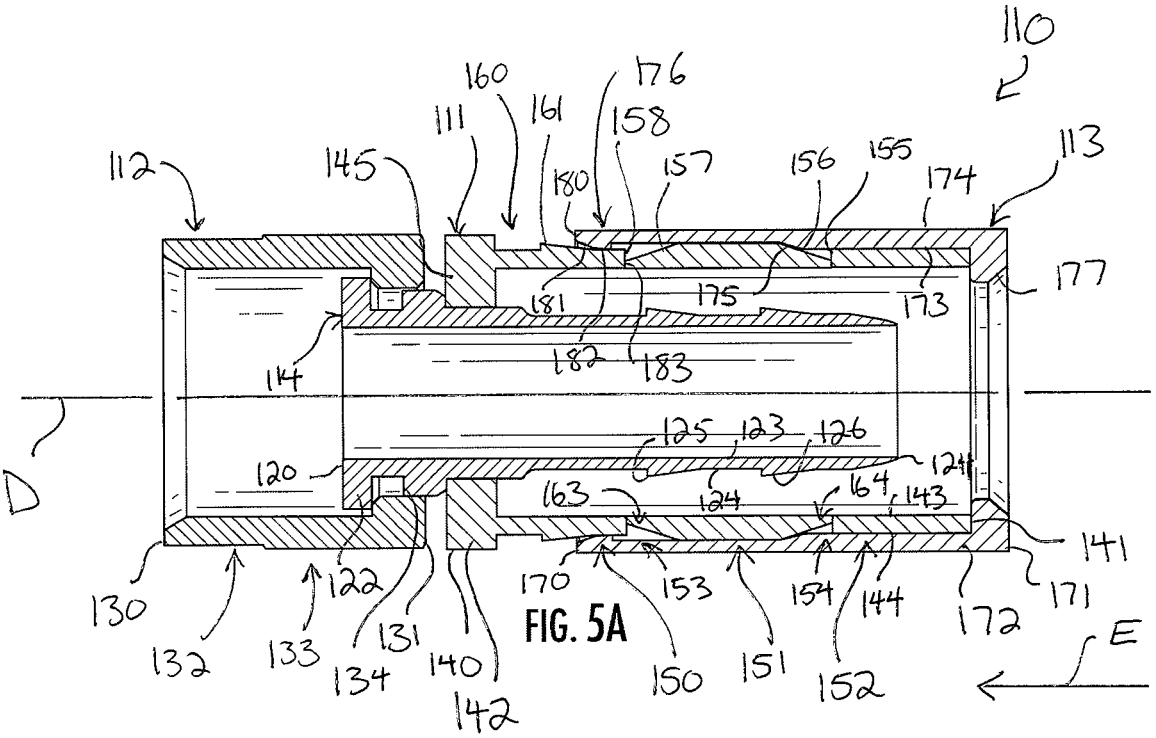
FIGS. 5A-5C are section views take along the line 5-5 in FIG. 4, showing the connector of FIG. 4 moving from an uncompressed condition to a compressed condition.

Referring primarily to FIG. 5A, the barrel 111 is an elongate, cylindrical sleeve extending along the longitudinal axis D with rotational symmetry thereabout, and is constructed of a material or combination of materials having strong, rigid, size memory, and shape-memory material characteristics, as well as a low coefficient of friction, such as plastic, metal, or the like. The barrel 111 receives and securely holds a cable introduced into the connector 110.

The barrel 111 has opposed front and rear ends 140 and 141 with a cylindrical sidewall 142 extending therebetween, which sidewall 142 has opposed inner and outer surfaces 143 and 144. The inner surface 143 defines and bounds a cable-receiving interior space shaped and sized to receive the coaxial cable, and in which the rear end 121 of the inner post 114 is disposed. An opening at the rear end 141 of the barrel 111 communicates with this cable-receiving interior space.

A front flange 145 is at the front end 140 of the barrel 111. The front flange 145 is a large, inwardly-turned annular lip which abuts and is seated on the outer surface 124 of the inner post 114 behind its front end 120. The front flange 145 is seated and secured on the outer surface 124 with a friction fit, thereby securing the barrel 111 on the inner post 114.

The sidewall 142 of the barrel 111 extends rearwardly from the front flange 145, and the front flange 145 has a smaller inner diameter than any part of the sidewall 142 behind the front flange 145. Briefly, some terms are used with respect to the embodiment of the connector 110 to refer to direction or location. "Rearwardly," "behind," and similar terms indicate that something extends, is directed, or is located proximate to or toward the rear end 141 of the barrel 111. Conversely, "forwardly," "ahead," and similar terms indicate that something extends, is directed, or is located proximate to or toward the front end 130 of the coupling nut 112.

The barrel 111 is constructed from a front sleeve 150, a middle sleeve 151, and a rear sleeve 152 which are integrally and monolithically formed to each other at annular, frangible bands 153 and 154. Nevertheless, the forward, middle, and rear sleeves 150, 151, and 152 are frangible; they are designed to separate from each other within the compression collar 113. Explained in more detail below, the front and rear sleeves 150 and 152 flank the middle sleeve 151, and when the compression collar 113 advances forward, the middle sleeve 151 separates from the front and rear sleeves 150 and 152 and slides between and under each of them. The front sleeve 150 deforms slightly, and the middle sleeve 151 is pushed radially inward. The barrel 111 is constructed to cause this separation in response to axial compression of the connector 110. The middle sleeve then captures the applied cable.

Still referring to FIG. 5A, the rear sleeve 152 is a short, cylindrical collar or cuff. The rear sleeve 152 includes the rear end 141 and the sidewall 142 of the barrel 111. From the rear end 141, the rear sleeve 152 extends forwardly to the frangible band 154, a rearward frangible band 154. A flat or blunt front face 155 projects radially outward from the frangible band 154. The front face 155 is roughly perpendicular to the axis D and defines the forward termination of the rear sleeve 152. The front face 155 has a height, from the frangible band 154 to the outer surface 124, which is approximately equal to that of the front sleeve 150, as defined below. The rear sleeve 152 is substantially rigid and maintains its shape and size during movement and arrangement of the connector 110. In this way, the rear sleeve 152 moves with the compression collar 113, in which it is encased, when the connector 110 is secured on the cable.

In front of the rear sleeve 152, the middle sleeve 151 is a cylindrical collar or cuff, slightly longer than the rear sleeve 152, and includes oblique rear and front faces 156 and 157 with a constant-thickness middle section therebetween. The oblique rear face 156 is oriented radially inward and axially forward, such that the rear face 156 presents radially outward and axially forward. The oblique front face 157 is oriented radially inward and axially rearward, such that the front face 157 presents radially outward and axially rearward. In this way, the rear and front faces 156 and 157 are annular ramps over which the front and rear sleeves 150 and 152, respectively, are driven when the connector 110 is compressed, as will be discussed. The middle sleeve 151 flanks the ridges 125 and 126; the front end of the middle sleeve 151 is in front of the ridge 125 and the rear end of the middle sleeve 151 is behind the ridge 126.

The rear sleeve 152 is joined to the middle sleeve 151 at the rearward frangible band 154. The frangible band 154 is the union between the middle sleeve 151 and the rear sleeve 152. Before the connector 110 is compressed, the barrel 111 is preferably a single, integral, monolithic piece and the middle sleeve 151 and rear sleeve 152 are constituent elements of that piece. The frangible band 154 joins the middle sleeve 151 to the rear sleeve 152; it is an axially-narrow, radially-thinned portion of the sidewall 142 of the barrel 111 formed between the rear face 156 of the middle sleeve 151 and the front face 155 of the rear sleeve 152. The frangible band 154 is preferably a thinned portion of the sidewall 142 which is continuous and annular and formed entirely to each of the rear face 156 and the front face 155. In alternate embodiments, however, the frangible band 154 has another structure, such as a series of small, circumferentially-separated fingers of the sidewall 142 formed between the two faces 156 and 155, or some other structure.

The frangible band 154 is radially encircled by the front face 155 of the rear sleeve 152, which front face 155 projects radially outward from the frangible band 154. The frangible band 154 is radially closer to the axis D than is the front face 155. Moreover, the rear face 156 of the middle sleeve rises obliquely away from the frangible band 154. Thus, a V-shaped annular notch 164 is defined above—or just radially beyond the frangible band 154—encircling the band 154. The notch 164 is bound by the frangible band 154, the rear face 156, and the compression collar 113.

In front of the middle sleeve 151, the front sleeve 150 is a cylindrical collar or cuff, slightly longer than the rear sleeve 152 and about the same length as the middle sleeve 151. It includes the front end 140 of the barrel 111 and the sidewall 142 extending rearwardly therefrom to a blunt rear face 158. Indeed, the front sleeve 150 extends from the front end 140 to the forward frangible band 153, because the frangible band 153 is formed between the front face 157 and the rear face 158. The rear face 158 is roughly perpendicular to the axis D and defines the rearward termination of the front sleeve 150. The rear face 158 has a height, from the forward frangible band 153 to the outer surface 144, which is approximately half the thickness of the middle sleeve 151 at its largest point between its inner and outer surfaces 143 and 144, in the middle section between the front and rear faces 157 and 156.

The front sleeve 150 further includes the front flange 145 and an annular channel 160, just behind the front flange 145, recessed into the sidewall 122 from the outer surface 124. Proximate to the channel 160, and cooperating with the front flange 145 to bound the channel 160 is a forward barb or ridge 161 which rises radially outward, such that when the compression collar 113 is advanced axially over it, the compression collar 113 biases the ridge radially inwardly slightly. Behind the ridge 161, the outer diameter of the sidewall 122 decreases slightly until it terminates at the blunt rear face 162. The flat rear face 162 projects radially inward from the outer diameter of the sidewall 122 to the forward frangible band 154.

The front sleeve 150 is joined to the middle sleeve 151 at the forward frangible band 153. The frangible band 153 is the union between the front and middle sleeves 150 and 151. Before the connector 110 is compressed, the barrel 111 is preferably a single, integral, monolithic piece and the front and middle sleeves 150 and 151 are constituent elements of that piece. The frangible band 153 joins the front sleeve 150 to the middle sleeve 151; it is an axially-narrow, radially-thinned portion of the sidewall 142 of the barrel 111 formed between the rear face 158 of the front sleeve 150 and the front face 157 of the middle sleeve 151. The frangible band 153 is preferably a thinned portion of the sidewall 142 which is continuous and annular and formed entirely to each of the rear face 158 and the front face 157. In alternate embodiments, however, the frangible band 153 has another structure, such as a series of small, circumferentially-separated fingers of the sidewall 142 formed between the two faces 157 and 158, or some other structure.

The frangible band 153 is radially encircled by the rear face 158 of the front sleeve 150, which rear face 158 projects radially outward from the frangible band 153. The frangible band 153 is radially closer to the axis D than is the rear face 158. Moreover, the front face 157 of the middle sleeve 151 rises obliquely away from the frangible band 153. Thus, a V-shaped annular notch 163 is defined above—or just radially beyond—the frangible band 153, encircling the band 153. The notch 163 is bound by the frangible band 153, the front face 157, and the compression collar 113.

Still referring to FIG. 5A, the compression collar 113 is mounted for reciprocal axial movement over the barrel 111. It includes opposed front and rear ends 170 and 171, an annular sidewall 172 extending between the front and rear ends 170 and 171, and opposed inner and outer surfaces 173 and 174. An interior space bound by the inner surface 173 extends into the compression collar 113 from an opening formed at the rear end 171 of the compression collar 113. The interior space is a cylindrical bore and is sized to receive the barrel 111 with the coaxial cable carried within. The compression collar 113 is fit onto the rear end 141 of the barrel 111 to limit the relative radial and rotational movement of the compression collar 113 on the barrel 111 with respect to the axis D. The compression collar 113 is constructed of a material or combination of materials having strong, hard, rigid, resilient, and durable material characteristics, such as metal, plastic, or the like. The compression collar 113 does not deform in response to movement between its retracted and advanced positions, or in response to deformation, movement, or other change of the barrel 111 within.

The compression collar 113 has a constant outer diameter from the front end 170 to just before the rear end 171. Most of the length of the sidewall 172 has one of two inner diameters; a larger inner diameter proximate the front end 170 (and resulting in a thinner sidewall 172 there) and a smaller inner diameter proximate the rear end 171 (and resulting in a thicker sidewall 172 there). At the rear end 171, the sidewall 172 has an inwardly-directed lip 177. The lip 177 has a reduced inner diameter relative the rest of the compression collar 113, and its inner diameter is smaller than the inner diameter of the barrel 111 at its rear end 141. Indeed, the inner diameter of the lip 177 is even smaller than the inner diameter of the barrel 111 at the rear end 141 of the barrel 111, such that it hangs over the rear end 141. The lip 177 serves as a stop against the barrel 111, so that, when the compression collar 113 is moved forward, the lip 177 contacts the rear end 141 of the barrel 111 and pushes the rear end 141 forward along the axis D, thereby urging compression of the barrel 111.

The inner diameter of the compression collar 113 is constant from the lip 177 forward, until an oblique face 175 approximately halfway along the length of the compression collar 113. The oblique face 175 extends into the sidewall 172, reducing its inner diameter. The oblique face 175 is an annular expansion extending radially into the sidewall 172 from the inner surface 173, and it has a larger inner diameter than the portion of the sidewall 172 behind it. The oblique face 175 is directed forward and into the connector 110, toward the axis D.

From the oblique face 175, the compression collar 112 continues to extend axially forward with a thinner sidewall 172 until a ring 176 at the front end 170. The ring 176 is an annular constriction of the sidewall 172, extending radially into the interior space within the compression collar 113, and defining a constricted forward mouth of the compression collar 113. The thickness of the ring 176, between its inner and outer diameters, is approximately one-third to one-half larger than the thickness of the sidewall 172 between its inner and outer surfaces 173 and 174 behind the ring 176. The inner diameter of the ring 176 corresponds to the outer diameter of channel 160 in the front sleeve 150.

The ring 176 is a projection extending radially inward. It includes a blunt front face 180, an oblique face 181, an inner face 182, and the rear face 183. The front face 180 is normal to the axis D, and the inner face 182 is parallel to it. The oblique face 181 extends between the front and inner faces 180 and 182 at a low angle degree angle, though other angles are suitable as well. The rear face 183 of the ring 176 is normal to the axis D and is directed toward the rear end 171 of the compression collar 113.

In operation, the cable connector 110 is useful for securely coupling a coaxial cable to an electronic component in electrical communication. Operation of the connector 110 is shown sequentially in FIGS. 5A-5C, which does not show a cable, and in FIGS. 6A-6C, which does show the cable 90 used in the above description of the connector 110. As above, preparation is conventional and need not be described in detail, but involves stripping back the jacket to expose the center conductor, a dielectric insulator, a flexible shield, and sometimes a braid. The connector 110 is initially in an uncompressed condition, and the compression collar 113 is in the retracted position, as shown in FIGS. 4, 5A, and 6A.

In the retracted position of the compression collar 113, the front end 170 of the compression collar 113 is behind the channel 160 and the ridge 161, such that the ring 176 is disposed between the ridge 161 and the forward frangible band 153. The lip 177 at the rear end 171 of the compression collar 113 is flush against the rear end 141 of the barrel 111, and the compression collar 113 does not compress, deform, or bias the barrel 111 or any part of the barrel 111. Rather, the compression collar 113 is merely fit to the barrel 111.

The coaxial cable 90 is advanced into the interior space of the barrel 111 and over the inner post 114 until the dielectric insulator 93 is proximate to the front end 120 of the inner post 114, the jacket 91 (with the flexible shield 94 bent over it) is proximate to the front flange 145, and the center conductor 92 extends beyond the front end 130 of the coupling nut 112. In this arrangement, the coaxial cable is fully applied into the connector 110, but the connector 110 is not secured on the coaxial cable 90. This is shown in FIGS. 4 and 6A.

Figure 6A:
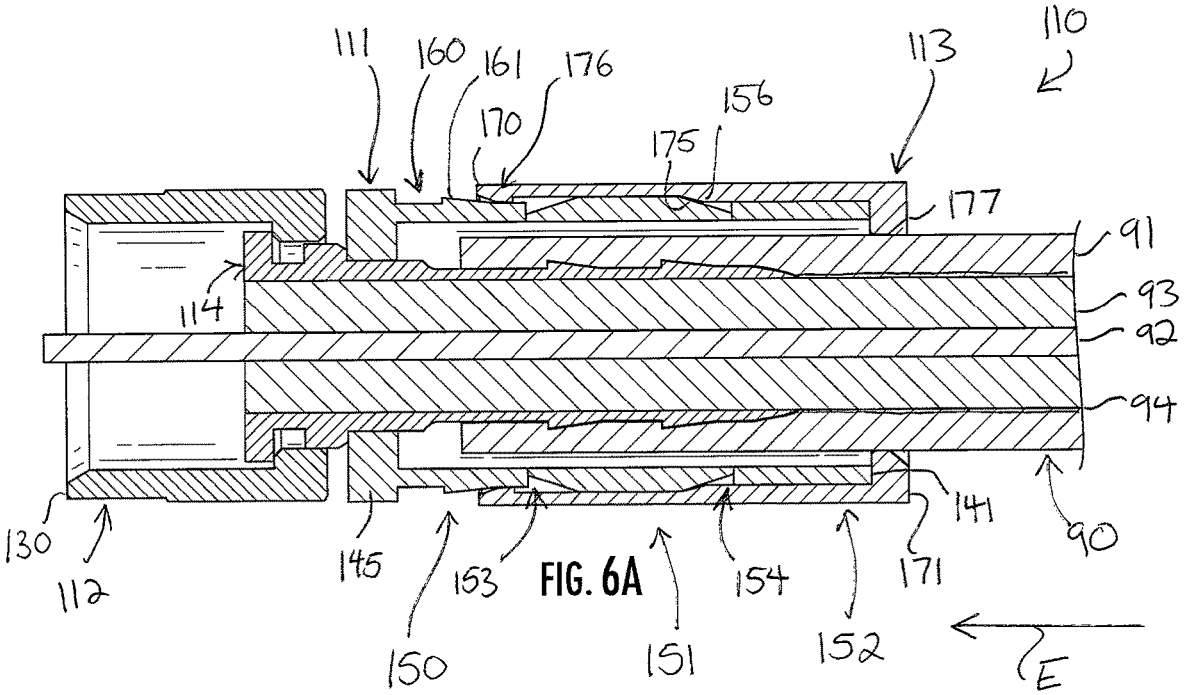
FIGS. 6A-6C are section views take along the line 5-5 in FIG. 4, showing the connector of FIG. 4, applied with a cable, moving from the uncompressed condition to the compressed condition.

To secure the connector 110 on the coaxial cable, the compression collar 113 is advanced forwardly along the direction indicated by the arrowed line E in FIGS. 5A and 6A. Briefly, forward movement of the compression collar 113 is preferably accomplished by a compression tool, but in some cases may be possible manually by hand. Certain designs of connectors, especially those with specially-designed coupling nuts 112, will accommodate manual, toolless, hand installation. Forward movement advances the compression collar 113 forwardly over the barrel 111 out of the retracted position. In the retracted position, the lip 177 is initially disposed against the rear end 141 of the barrel 111, and the ring 176 is disposed between the ridge 161 and the forward frangible band 153. The oblique face 175 of the compression collar 113 is disposed in contact against the sloping rear face 156 of the middle sleeve 151 of the barrel 111.

Figure 5B:
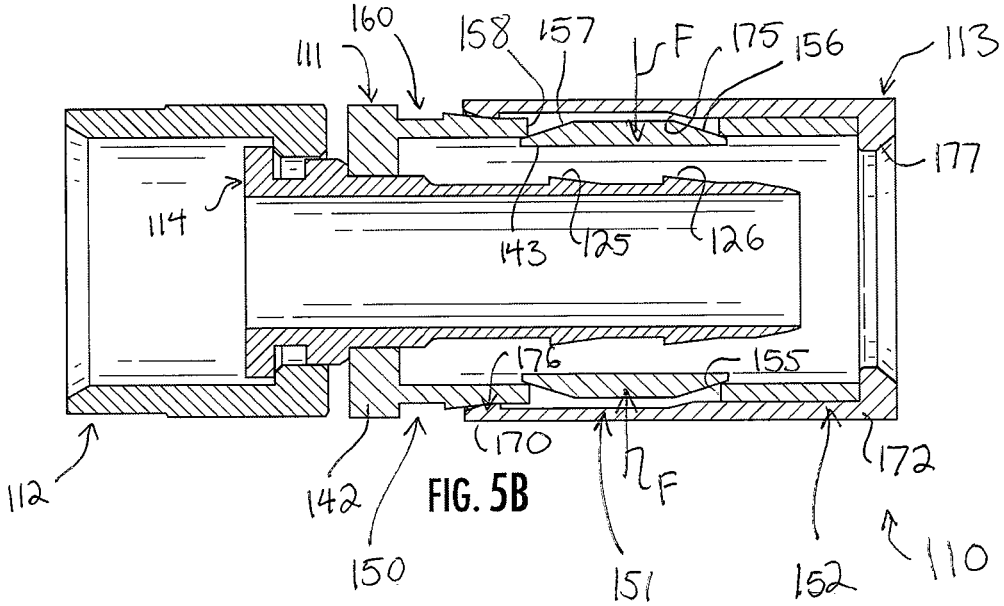
Figure 6B:
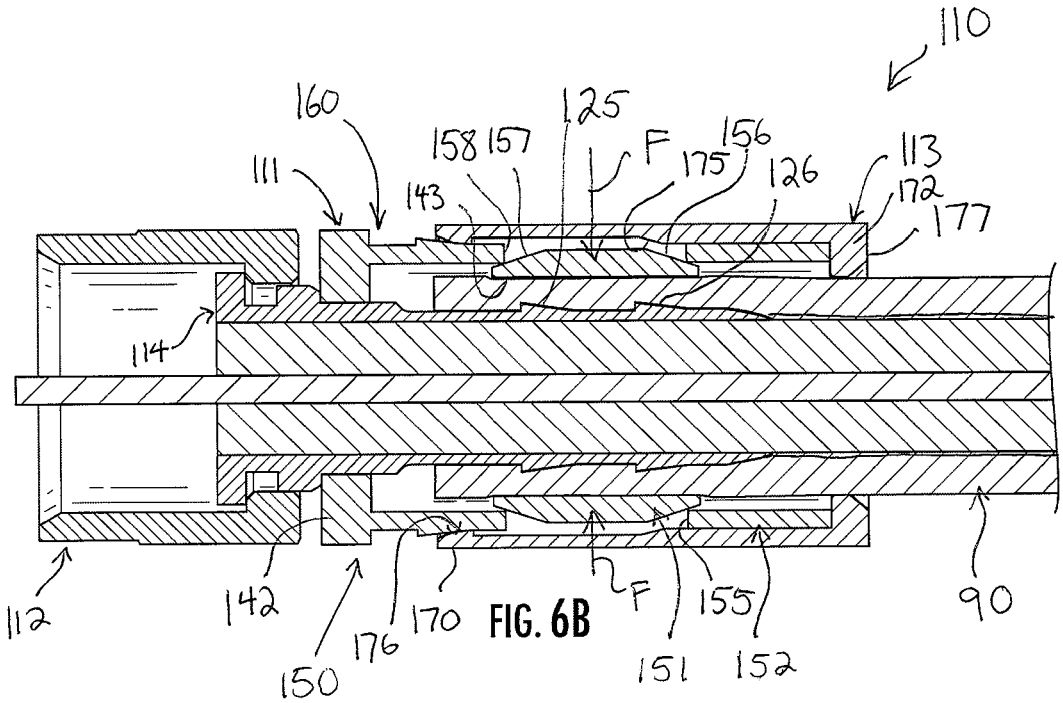

As shown in both FIGS. 5A and 6A, when the compression collar 113 is advanced forward along the arrowed line E, the oblique face 175 slides against the sloping rear face 156 of the middle sleeve 151. Because the compression collar 113 is constructed of strong, hard, rigid, resilient, and durable material characteristics, it urges the sloping rear face 156 radially inward in deformation, as shown in FIGS. 5B and 6B by the two arrowed lines F. Moreover, the lip 177 pushes the rear sleeve 152 axially forwardly while the sloping rear face 156 is being urged inwardly. The sidewall 142 at the frangible band 153 is thin in comparison to the rest of the barrel 111, and so force of the deformation is concentrated here. However, the forward frangible band 153 is also a thin portion of the sidewall 142, and so deformation is concentrated here as well. As such, when the sloping rear face 156 is urged inwardly, the middle sleeve 151 hinges at the forward frangible band 153, which yields and severs in response. Both frangible bands 153 and 154 tear. The tearing of the forward frangible band 153 and the rearward frangible band 154 severs and separates the middle sleeve 151 from both the front sleeve 150 and the rear sleeve 152.

The sloping rear face 156 begins to slide under, or within, the rear sleeve 152, and the sloping front face 157 begins to slide under, or within, the front sleeve 150 at the flat rear face 158. The front sleeve 150, behind the front flange 145, tends to maintain its cylindrical shape once the middle sleeve 151 has detached from it. The front and rear sleeves 150 and 152 thus move axially together with respect to each other, and the middle sleeve 151 is pushed radially inward along the arrowed lines F by the axial closure of space between the front and rear sleeves 150 and 152 as the compression collar 113 moves axially forward. The gap or distance between ridges 125 and 126 on the inner post 114 and the inner surface 143 of the middle sleeve 151 decreases. The middle sleeve 151 is a now free piece contained within the connector 110 by the sidewall 172 of the compression collar 13, the front face 155 of the rear sleeve 152, and the rear face 158 of the front sleeve 150.

Figure 5C:
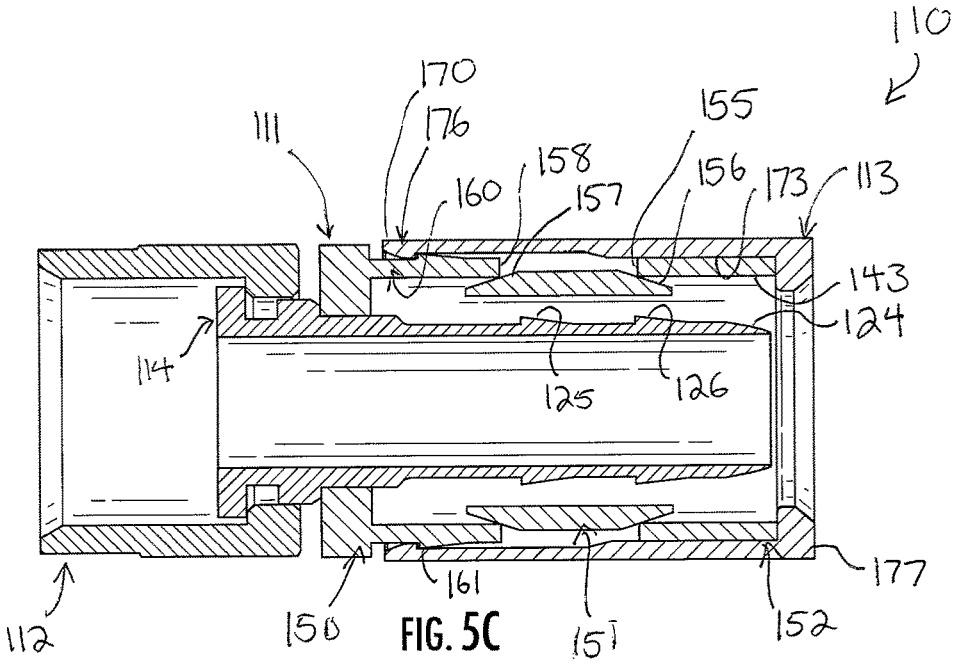
Figure 6C:
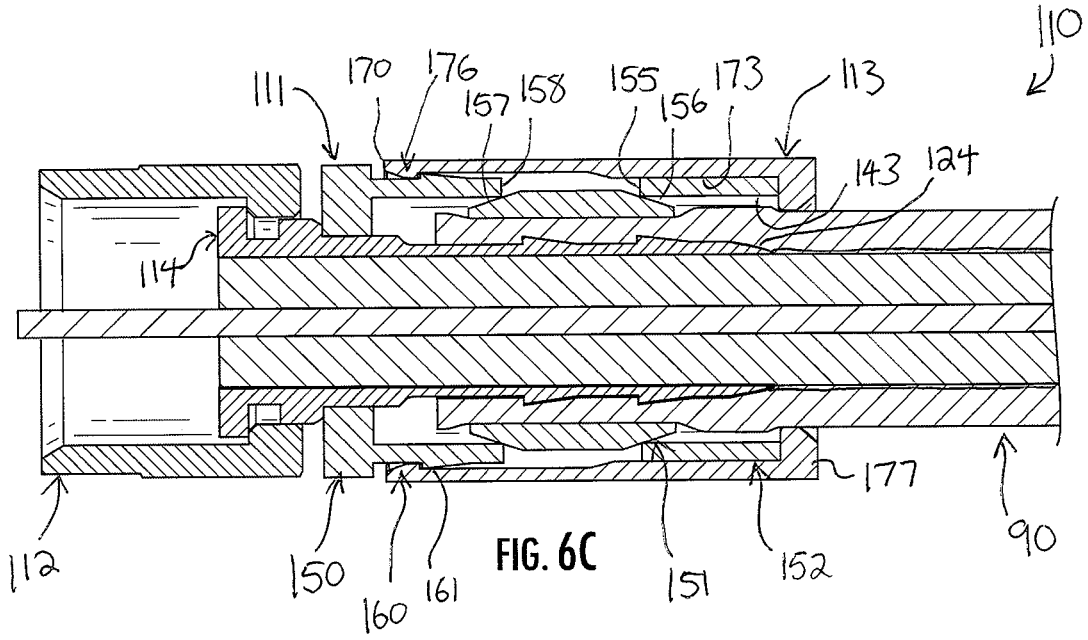

In FIG. 6B, the ring 176 and the front end 170 of the compression collar 113 are not yet in the channel 160 of the barrel 111, and so the compression collar 113 can be further advanced along line E. Further advancement arranges the connector 110 as shown in FIGS. 5C and 6C, with the compression collar 113 in the advanced position thereof. Here, the ring 176 is snappedly received and seated into the channel 160 in front of the ridge 161. The ridge 161 prevents retraction of the ring 176 out of the channel 160 and thus prevents retraction of the compression collar 113 off of the barrel 111.

As shown in FIGS. 5C and 6C, the middle sleeve 151 has fully moved radially inward. In FIGS. 5C and 6C, it can be seen that the moved middle sleeve 151 has reduced the gap between the outer surface 124 of the inner post 114 and the inner surface 143 of the barrel 111 (or what was once the barrel 111—the middle sleeve 151). This gap is not just reduced in a single annular location, but is reduced across the entire of the length of the middle sleeve 151, from the torn frangible band 153 to the torn frangible band 154. As such, the middle sleeve 151 crimps the cable 90 along a considerable length of the cable 90, thereby preventing the cable 90 from getting "pinched" at a single location.

In the advanced position of the compression collar 113, both the rear sleeve 152 and the middle sleeve 151 "float" within the interior of the connector 110 because each is free. However, the rear sleeve 152 is nevertheless prevented from axial, radial, or rotational movement by its tight fit between the inner surface 173 of the compression collar 113, the lip 177, and the sloping rear face 156 of the middle sleeve 151. Similarly, the middle sleeve 151 is also prevented from axial, radial, or rotational movement by its tight fit between the cable 90 and the front and rear sleeves 150 and 152 encircling it. Further, this arrangement prevents the cable 90 from being retracted; if the cable 90 is inadvertently pulled backward, it would urge the separated middle sleeve 151 radially outward, in confrontation with both of the front and rear sleeves 150 and 152. However, the front and rear sleeves 150 and 152 are both bound and not moveable. Since the front and rear sleeves 150 and 152 are hard, they prevent the middle sleeve 151 from being moved radially outward, and thereby prevent the cable 90 from being pulled out of the connector 110.

A preferred embodiment is fully and clearly described above so as to enable one having skill in the art to understand, make, and use the same. Those skilled in the art will recognize that modifications may be made to the description above without departing from the spirit of the invention, and that some embodiments include only those elements and features described, or a subset thereof. To the extent that modifications do not depart from the spirit of the invention, they are intended to be included within the scope thereof.

The invention claimed is:

1. A coaxial cable connector comprising:

an inner post and a coupling interface mounted on the inner post;

a barrel mounted on the inner post, the barrel including a front sleeve and a rear sleeve coupled to each other at a frangible band; and a compression collar mounted over the barrel for movement between a retracted position and an advanced position;

wherein movement of the compression collar from the retracted position to the advanced position severs the frangible band, thereby separating the front sleeve from the rear sleeve; and wherein the barrel includes a forwardly-directed shoulder, a forwardly-directed ridge in front of the shoulder, and a recessed annular channel in front of the ridge, and the compression collar includes an inwardly-directed ring which moves over the ridge and into the channel during movement from the retracted position to the advanced position.

2. The coaxial cable connector of claim 1, wherein the frangible band is annular.

3. The coaxial cable connector of claim 1, wherein the frangible band is a thinned portion of a sidewall of the barrel.

4. The coaxial cable connector of claim 1, wherein the front sleeve terminates rearwardly with an oblique face and the rear sleeve terminates forwardly with a blunt face.

5. The coaxial cable connector of claim 1, wherein the front sleeve terminates rearwardly between two axially spaced-apart ridges formed on the inner post.

6. The coaxial cable connector of claim 1, wherein in the retraced position of the compression collar, the ring is disposed between the shoulder and the ridge.

7. The coaxial cable connector of claim 1, wherein in the advanced position of the compression collar, the ring is disposed in the channel.

8. A coaxial cable connector comprising:

an inner post;

a barrel mounted on the inner post, the barrel including a front sleeve and a rear sleeve coupled to each other at a frangible band; and a compression collar mounted over the barrel for movement between a retracted position and an advanced position;

wherein the rear sleeve separates from the front sleeve when the compression collar moves from the retracted position to the advanced position thereof; and wherein the barrel includes a forwardly-directed shoulder, a forwardly-directed ridge in front of the shoulder, and a recessed annular channel in front of the ridge, and the compression collar includes an inwardly-directed ring which moves over the ridge and the channel during movement from the retracted position to the advanced position.

9. The coaxial cable connector of claim 8, wherein the frangible band is annular.

10. The coaxial cable connector of claim 8, wherein the frangible band is a thinned portion of a sidewall of the barrel.

11. The coaxial cable connector of claim 8, wherein the front sleeve terminates rearwardly with an oblique face and the rear sleeve terminates forwardly with a blunt face.

12. The coaxial cable connector of claim 8, wherein the front sleeve terminates rearwardly between two axially spaced-apart ridges formed on the inner post.

13. The coaxial cable connector of claim 8, wherein in the retraced position of the compression collar, the ring is disposed between the shoulder and the ridge.

14. The coaxial cable connector of claim 8, wherein in the advanced position of the compression collar, the ring is disposed in the channel.

15. A coaxial cable connector comprising:

an inner post;

a barrel mounted on the inner post, the barrel including front sleeve, a middle sleeve, and a rear sleeve, each formed integrally as part of the barrel; and a compression collar mounted over the barrel for movement between a retracted position and an advanced position;

wherein the middle sleeve separates from each of the front and rear sleeves when the compression collar moves from the retracted position to the advanced position thereof.

16. The coaxial cable connector of claim 15, wherein:

the front sleeve terminates rearwardly with a blunt face;

the middle sleeve terminates forwardly and rearwardly with oblique front and rear faces, respectively; and the rear sleeve terminates forwadly with a blunt face.

17. The coaxial cable connector of claim 15, wherein the barrel includes a forward frangible band and a rearward frangible band flanking the middle sleeve.

18. The coaxial cable connector of claim 17, further comprising:

a recessed annular channel formed into the barrel in front of the forward frangible band; and an inwardly-directed ring formed in the compression collar which, in the retracted position of the compression collar, is disposed between the channel and the forward frangible band, and in the advanced position of the compression collar, is disposed in the channel.

19. The coaxial cable connector of claim 17, wherein the front and rear sleeves move axially with respect to each other when the compression collar moves from the retracted position to the advanced position.

20. The coaxial cable connector of claim 17, wherein the middle sleeve moves radially inward when the compression collar moves from the retracted position to the advanced position.

* * * * *